United States Patent [19]

Lechler

[11] Patent Number: 4,988,043

[45] Date of Patent: Jan. 29, 1991

[54] NOZZLE FOR ATOMIZING LIQUID MEDIA, IN PARTICULAR A FAN-JET NOZZLE

[75] Inventor: Walter H. Lechler, Stuttgart, Fed. Rep. of Germany

[73] Assignee: 501 Lechler GmbH & Co. KG, Fellbach, Fed. Rep. of Germany

[21] Appl. No.: 410,418

[22] Filed: Sep. 21, 1989

[51] Int. Cl.[5] ..... B05B 1/04

[52] U.S. Cl. ..... 239/597; 239/590.3; 239/591; 239/600

[58] Field of Search ..... 239/390, 391, 396, 397, 239/590.3, 591, 597, 598, 600, 599

[56] References Cited

U.S. PATENT DOCUMENTS

| | | | |
|---|---|---|---|
| 2,107,601 | 2/1938 | Davis | 239/600 |
| 2,946,518 | 7/1960 | Wahlin | 239/600 |
| 3,065,918 | 11/1962 | Hostetter | 239/590.3 |
| 3,273,805 | 9/1966 | Hall | 239/590.3 |
| 3,754,710 | 8/1973 | Chimura | 239/597 |
| 3,865,314 | 2/1975 | Levey et al. | 239/590.3 |
| 4,645,127 | 2/1987 | Emory et al. | 239/600 |
| 4,702,420 | 10/1987 | Rath | 239/391 |

FOREIGN PATENT DOCUMENTS

| | | |
|---|---|---|
| 7724108 | 1/1978 | Fed. Rep. of Germany . |
| 3216945 | 11/1983 | Fed. Rep. of Germany . |
| 393148 | 10/1965 | Switzerland . |

*Primary Examiner*—Andres Kashnikow
*Assistant Examiner*—Michael J. Forman
*Attorney, Agent, or Firm*—Shlesinger & Myers

[57] ABSTRACT

A nozzle for atomizing liquid media, in particular a fan-jet nozzle, comprising a nozzle housing determining by its external dimensions and its fitting means the particular nozzle type, and a nozzle internal structure enclosed by the nozzle housing in turn determining the nozzle type functionally, both the nozzle housing and the nozzle inner structure being made of the same material. The nozzle housing on one hand and on the other the nozzle inner structure (nozzle inset) are separate integral parts, and the nozzle inset is force-fitted in undetachable manner into the nozzle housing. Such separate manufacture of the nozzle housing on one hand and on the other the nozzle inset determining the nozzle inner geometry (functional geometry) allows improving applicability and storage costs while simultaneously lowering the manufacturing and storage costs of said nozzle.

7 Claims, 2 Drawing Sheets

NOZZLE FOR ATOMIZING LIQUID MEDIA, IN PARTICULAR A FAN-JET NOZZLE

Figure 1:
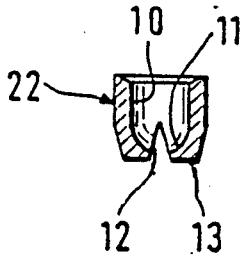

The invention concerns a nozzle for atomizing liquid media, in particular a fan-jet nozzle, comprising a nozzle housing determining the type of nozzle by means of the outer dimensions and the hook-up devices, further comprising an internal nozzle structure enclosed by the nozzle housing and determining functionally the type of nozzle (preferably regarding flow and angle of jet), the nozzle housing and the inner structure being made of the same material.

Nozzles consisting of a uniform material which is comparatively easily to machine, for instance stainless steel, brass etc. generally are made of one piece as regards the nozzle housing and its inside geometry, where this inside geometry is machined—for instance by cutting—into the housing. Most of these nozzles are the fan jet type.

Such integrally manufactured nozzles can be distinguished by the following criteria:

1. According to output (in particular as given by the flow rate,
2. According to the angle of the jet,
3. According to the kind of housing fitting (type of thread, size of thread, quick-connect, coupling rings),
4. According to overall size, and
5. According to material used.

One-piece nozzles of the above described kind therefore are sub-divided into many types. As a result, in most instances, mass production will be unfeasible, and storage presents problems because of the uncertainty of future demand for the particular types and because of the costs. The above disadvantages in particular cause restrictions on short-term deliveries.

However as regards circular-jet nozzles (full-cone nozzles or hollow-cone nozzles) it is possible and known to vary the nozzle discharge by a mouth-piece (screw-connection) detachable attached to the nozzle housing and thereby to change the nozzle output, possibly also the jet-angle. However such a solution is impossible for fan-jet nozzles because a threaded connection between the nozzle mouth-piece and nozzle housing does not permit reliable alignment of the fan jet in a particular plane of the jet. (This problem, as already mentioned, does not exist in circular-jet nozzle with a symmetry-of-rotation jet).

It is further known to make nozzles consisting of a uniform material in two halves, the intersection passing through the flow axis or being parallel to it. When the nozzle is assembled, the two halves are loosely placed against each other and then are forced together by the joining piece and coupling ring and are held together in their assembled position in this manner. However such a nozzle manufacture by halves is applicable only when the internal nozzle structure is so special that it can be processed only at open parts.

Starting with the above state of the art, it is the object of the present invention to create an initially discussed nozzle type, in particular a fan-jet nozzle in order to secure improved geometries and terms of delivery while at the same time lowering the manufacturing and storage costs.

This problem is solved by the invention in that the nozzle housing on one hand and the nozzle structure (nozzle inset) on the other hand shall be separate parts and in that the nozzle inset shall be forced into the nozzle housing in undetachable manner.

Multiple-part nozzles for which the external nozzle housing, for instance with a threaded connection means, and a nozzle inset determining the nozzle geometry are each manufactured as separate parts already are known per se. However—and differing from the initially denoted nozzle species—their nozzle insets and made of a material different from that of the nozzle housings. Whereas an especially wear resistant and hence brittle material is used for the nozzle inset, for instance for hydrodynamic reasons and/or with regard to corrosion, for instance a hard metal, the nozzle housing on the other hand cannot be made of such a material. A nozzle entirely made of a brittle, wear-resistant material, for instance a hard metal, could not be assembled (threading problems) and also there would be the risk of fracture.

However the essential merit of the author of the present invention is to have had the insight that contrary to integral manufacture recommending itself for technical reasons, Multi-part production will also offer very substantial advantages even for nozzles of the initially cited kind, over one-piece nozzle manufacture, in the invention however the nozzle housing and the nozzle inset each being manufactured undivided. The advantages offered by the present invention consist on one hand of lowering the number of types of the manufactured parts while the number of types of finished nozzles remains as before. Also, the invention allows increasing the lot sizes of the components. Again the production costs are lowered because of the higher output. Lastly the invention also makes it possible to improve deliveries while lowering storage costs because each component in storage can be used in several different types of finished nozzles.

Because the invention allows combining the manufactured individual parts into large series of produced items, on the whole the costs of mass-produced nozzles made of expensive materials can be lowered to the levels of nozzles of cheaper materials produced in small runs. Accordingly nozzles made of more precious and more expensive materials are becoming competitive also for simpler applications. As a result there is further emphasis on fewer produced parts and thereby further rationalization is possible.

In a further development of the invention's basic concept advantageous to manufacture and assembly, the nozzle housing inside space receiving the nozzle inset shall be a cylindrical cavity merging by means of an offset near the nozzle discharge into a diametrical slot, the offset serving as a rest for the assembly position of the nozzle inset. The offset cylindrical cavity can be achieved in simpler manner, for instance as a borehole.

Appropriately the nozzle inset comprises a planar end face at the flow side whereby it rests when in its assembled position against the offset of the cylindrical cavity in the nozzle housing.

In another advantageous embodiment of the invention, a collar may be formed at the rear end of the nozzle inset whereby the nozzle inset when in its assembly position can come to rest against the offset of the cylindrical cavity in the nozzle housing.

The above variation again permits two alternatives:

(a) The front end face forming the nozzle discharge of the nozzle inset is moved back inside the nozzle housing, just as for the end-face rest against the offset of the cylindrical nozzle housing cavity, (b) The front end face forming the nozzle discharge projects beyond the front end of the nozzle housing.

Preferably and in another embodiment of the invention, the nozzle housing inner chamber receiving the nozzle inset shall be a continuous cavity, for instance a borehole of constant diameter.

In that case the nozzle inset may be of such a length or it may be mounted in the cylindrical cavity so much forward as seen in the direction of flow that the nozzle discharge shall project beyond the end of the nozzle housing.

Obviously the design of the cylindrical nozzle housing cavity also includes the possibility to move back the nozzle inset or nozzle discharge into the nozzle housing.

The invention is elucidated below by embodiments illustrated in the drawings. All Figures are in longitudinal section.

Figure 2:
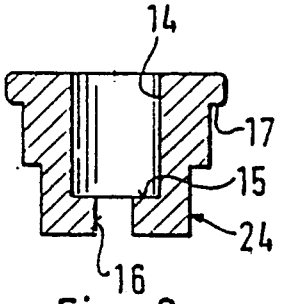
Figure 3:
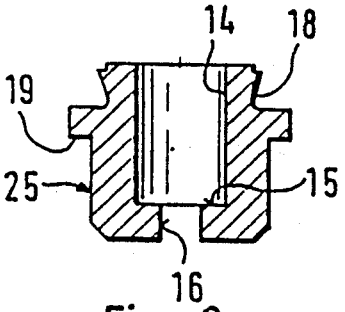
Figure 4:
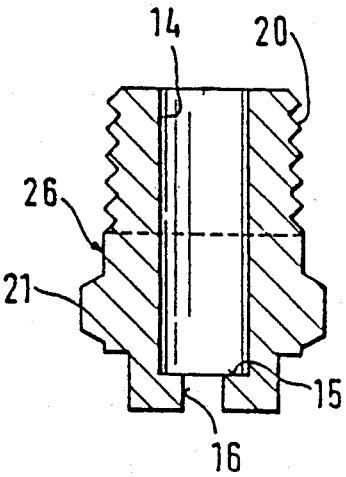
Figure 5:
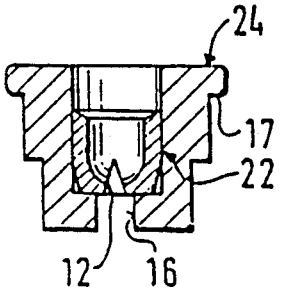
Figure 6:
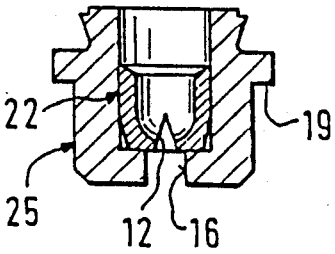
Figure 7:
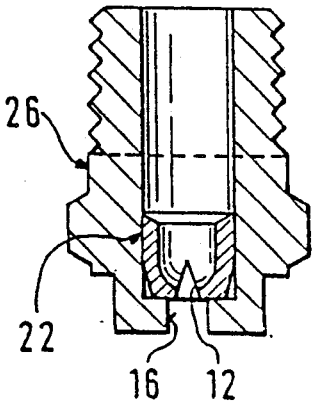

FIG. 1 is the internal (functional) geometry of a nozzle inset determining a fan-jet nozzle, shown separately, FIG. 2 through 4 are three different embodiment modes of nozzle housings determining the dimensions and the fitting types of the particular nozzles, FIG. 5 through 7 are three different embodiment modes, i.e. nozzle types of a completely assembled fan-jet nozzle each consisting of the nozzle inset FIG. 1 and of a nozzle housing of FIGS. 2 through 4, FIG. 8 is a further embodiment of a completely assembled fan-jet nozzle with a variation of the nozzle inset relative to the embodiment mode of FIG. 1.

Figure 8:
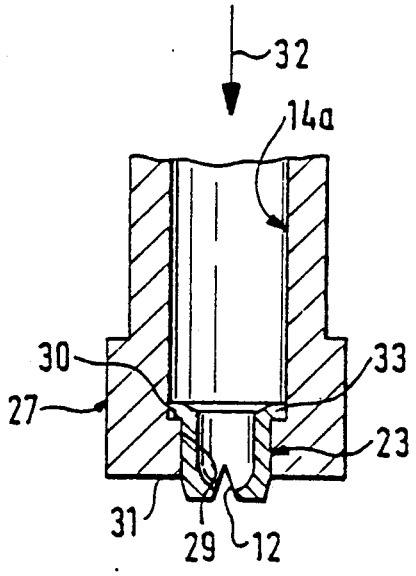
Figure 9:
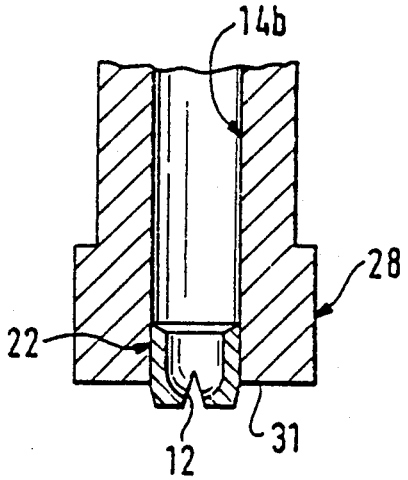
Figure 11:
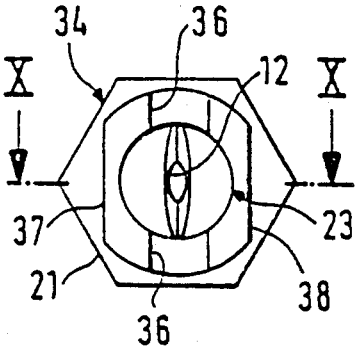
Figure 10:
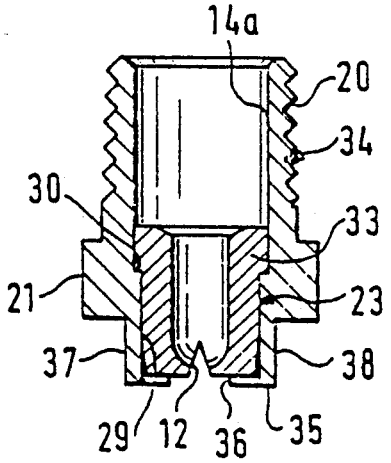

FIG. 9 is a further embodiment of a fully assembled fan-jet nozzle with a nozzle housing different from the variations shown in FIGS. 2 through 8, FIG. 10 is another variation of a fully assembled fan-jet nozzle with a nozzle inset similar to the embodiment of FIG. 8 but with a nozzle housing different from that embodiment's, and, FIG. 11 shows the fan-jet nozzle of FIG. 10 as seen from below. The nozzle inset denoted by 22 in FIGS. 1, 5 through 7 and 9 and the nozzle inset 23 of FIGS. 8, 10 and 11 is a metal part processed in suitable manner, for instance by cutting. The nozzle inset 22, 23 comprises an inner chamber 10 illustratively with a spherically rounded bottom 11. The selected plane of the drawing shows a nozzle discharge slot 12 conically flaring outward and determining the jet-geometry of the particular fan-jet nozzle, and is produced by machining from the flat end face 13 of the nozzle inset 22, 23 into this nozzle.

The nozzle housings denoted by 24–26 in FIGS. 2–4 are all ready to accept assembly of the nozzle inset 22 of FIG. 1 as shown by FIGS. 5–7.

However a nozzle inset of the kind shown in FIG. 1 also may be installed in the nozzle housings 27, 28 and 34 resp. of FIGS. 9, 10 and 11.

Each nozzle housing 24–27 and 34 comprises an offset cylindrical cavity 14 and **14*a* (FIGS. 8 and 10). In the housing variations of FIGS. 2–4, the diameter of the cylindrical cavity 14 corresponds to the outside diameter of the nozzle inset 22 of FIG. 1. An offset 15 at the nozzle discharge side in every instance acts as a rest surface for the plane end face 13 of the nozzle inset 22 of FIG. 1. To make possible the emission of the liquid jet, slotted discharge apertures are present in the nozzle housings 24–26 which, as regards the embodiment modes are shown in FIGS. 2–7, are identical for all nozzle housings 24–26 and therefore are uniformly denoted by 16**.

In the embodiment mode shown in FIG. 8 and in FIGS. 10 and 11, the inside space of the nozzle housing 27 is a continuous cylindrical cavity and denoted by **14*a*. The diameter of the cylindrical cavity 14*a* constricts stepwise toward an end zone on the flow side by means of an offset 30. This end zone 29 receives a nozzle inset 23 with a matching outside diameter, as shown by FIGS. 8 and 10**.

The embodiment mode shown in FIG. 9 is characterized in that the inside space **14*b* of the nozzle 28 receiving the nozzle inset 22 is a continuous borehole with constant diameter. In this embodiment mode the nozzle inset 22 is mounted so far ahead as Seen in the direction of flow 32, i.e. it is so long, that the nozzle discharge 12 projects beyond the end face 31, of the nozzle housing 28**.

The advantages of the continuous borehole **14*b* of FIG. 9 are on one hand the simple and economical manufacture and on the other that the nozzle inset can be positioned almost arbitrarily in the axial direction inside the nozzle housing 28**.

The nozzle housing 24 shown in FIGS. 2 and 5 determines the type of nozzle by its type of fitting, this nozzle being connected by a coupling nut (omitted) to the particular line connector (also omitted) where so called for.

The nozzle housing shown in FIGS. 3 and 6 is designed for two different types of hook-up. On one hand it comprises a dovetailed coupling part 18 whereby it can be fastened into a matching dovetail guide of the associated line hook-up (omitted). On the other hand the nozzle housing of FIGS. 3 and 6 also comprises a collar 19 which similarly to the embodiment mode of FIGS. 2 and 5 can act as the retaining surface of a coupling nut.

The nozzle housing 26 and 34 of FIGS. 4 and 7 are provided with an external thread as shown in FIGS. 10 and 11 and assume the shape of a hexagonal nut at their front, with a similar design applying also to the nozzle housing 27 and 28 of FIGS. 8 and 9. The nozzle type determined by this kind of hook-up can be screwed into a matching inner thread of the associated line hook-up (omitted).

The assembly of the nozzle inset 22 and 23 into the pertinent nozzle housing 24–28 and 34 to achieve the complete fan-jet nozzle of FIGS. 5, 6, 7, 8, 9, 10 and 11 resp. is carried out by press-fitting. Obviously the embodiment modes shown are only a small number of the many possible variations. Illustratively the types of nozzle housings shown in FIGS. 2–4 can be combined with nozzle insets which differ by their inside geometries from that of the nozzle inset 22 illustratively shown in FIG. 1. Inversely, the nozzle inset 22 of FIG. 1 obviously may be combined with the most diverse types of nozzle housing more or less deviating from the embodiment modes shown in FIGS. 2–11.

Now the embodiment mode FIGS. 10 and 11 offers the particular that the nozzle discharge 12 comes to rest in the end zone 29 with a constricted diameter of the cylindrical cavity **14*a* in the nozzle housing 34. This step can be achieved by correspondingly sizing the nozzle inset 12 and/or by a corresponding displacement back of the offset 30. The resulting end zone of the borehole 29 so resulting at the end 35 on the discharge side of the nozzle housing 34 comprising a free, milled-in slot 36. As shown by FIG. 11, this clear slot is so arranged, i.e. aligned, as to be parallel and axially symmetric to the slotted nozzle discharge 12. At the same time the end 35 at the discharge side is in the form of a two-edge of which the diametrically opposite sides 37**, 38 are parallel to the nozzle discharge slot 12 and to the slotted clear milling 36. Both parallel elements, namely the two-edge surfaces 37, 38 and the clear milling 36 facilitate the required alignment of the plane of the fan-jet (=the plane of the fan jet generated through slotted nozzle discharge 12) when assembling the nozzle.

I claim:

1. A fan-jet nozzle for atomizing liquid media, comprising:

(a) a nozzle housing means forming an exterior shell having a first end for connection to a fluid supplying means, (b) said nozzle housing means having an interior cylindrical cavity extending from said first end, (c) said nozzle housing means having a second end, (d) said second end having a slot formed therein extending from said second end to said cavity, (e) said nozzle housing means having a rest surface formed where said slot meets said cavity, (f) a nozzle inset means for atomizing a liquid media, (g) said nozzle inset means is undetachably press-fitted within said cylindrical cavity, (h) said nozzle inset means has formed therein a hollow chamber and having a liquid media receiving opening at one end and a smaller liquid media discharge opening at a second end, (i) said discharge opening is positioned to expel atomized liquid media through said slot, (j) said nozzle inset means having a flat end-face which engages said rest surface.

2. The fan-jet nozzle as defined in claim 1, wherein:

(a) said discharge opening forms a V-shaped aperture and, (b) said V-shaped aperture is aligned with said slot so that atomized liquid media may flow unimpeded through said nozzle housing means from said discharge opening.

3. The fan-jet nozzle as defined in claim 2 wherein:

(a) said V-shaped aperture is parallel and axially symmetric to said slot.

4. The fan-jet nozzle as defined in claim 3 wherein:

(a) said discharge opening of said nozzle inset means extends through said second cylindrical cavity and protrudes from said nozzle housing means.

5. The fan-jet nozzle of claim 3, wherein:

(a) said nozzle housing means extends beyond said discharge opening, and (b) said nozzle housing means includes a slot milled in said second end, (c) said discharge opening forms an elongated groove, (d) said slot is aligned with said groove so that the flow of atomized liquid media is not impeded by said nozzle housing means.

6. A fan-jet nozzle for atomizing liquid media, comprising:

(a) a nozzle housing means forming an exterior shell having a first end adapted for connection to a fluid supplying means, (b) said nozzle housing means having a cylindrical interior bore of constant diameter extending therethrough from said first end to a second end thereof, (c) nozzle inset means for atomizing a liquid media, (d) said nozzle inset means having formed therein a hollow chamber and having a liquid media receiving opening at a firs end thereof and a discharge opening at a second end thereof, (e) whereby, said nozzle inset means is press-fitted within said bore and said discharge opening extends outwardly from said bore.

7. A fan-jet nozzle for atomizing liquid media, comprising:

(a) a nozzle housing means forming an exterior shell having a first end adapted for connection to a fluid supplying means, (b) said nozzle housing means having a first interior cylindrical cavity extending from said first end, (c) said nozzle housing means having a second interior cylindrical cavity extending from a second end thereof to said first cylindrical cavity, (d) said second cylindrical cavity being of smaller diameter than said first cylindrical cavity so that a step is formed in the interior of said nozzle housing means, (e) a nozzle inset means for atomizing a liquid media, (f) said nozzle inset means has formed therein a hollow chamber and having a liquid media receiving opening at a first end and a smaller discharge opening at a second end, (g) said nozzle inset means having a flange extending outwardly from said liquid media receiving opening, (h) whereby said nozzle inset means is press-fitted within said second cylindrical cavity and said flange engages said step.

* * * * *